United States Patent [19]

Verdun

[11] Patent Number: 5,066,240

[45] Date of Patent: Nov. 19, 1991

[54] HIGH DENSITY ELECTRICAL CONNECTOR WITH ELECTROSTATIC DISCHARGE PROTECTION

[75] Inventor: Gary J. Verdun, Houston, Tex.

[73] Assignee: Compaq Computer Corporation, Houston, Tex.

[21] Appl. No.: 557,675

[22] Filed: Jul. 24, 1990

[51] Int. Cl.[5] ..... H01R 13/53

[52] U.S. Cl. ..... 439/181; 439/607

[58] Field of Search ..... 439/92, 95, 101, 108, 439/181, 186, 607, 608, 609, 610

[56] References Cited

U.S. PATENT DOCUMENTS

| | | | |
|---|---|---|---|
| 3,395,377 | 7/1968 | Straus | 439/61 |
| 3,692,966 | 9/1972 | Lancaster | 439/61 X |
| 4,699,438 | 10/1987 | Kikuta | 439/607 X |
| 4,773,878 | 9/1988 | Hansell, III | 439/610 X |
| 4,824,377 | 4/1989 | De Burro | 439/607 X |
| 4,889,497 | 12/1989 | Riches | 439/610 X |

*Primary Examiner*—Neil Abrams
*Assistant Examiner*—Khiem Nguyen
*Attorney, Agent, or Firm*—Johnson & Gibbs

[57] ABSTRACT

A high density electrical connector comprised of a block of insulative material having a plurality of electrical contacts for providing plural electrical connections and an electrical conductor for providing electrostatic discharge protection for the electrical contacts mounted thereto. The electrical conductor is positioned forward of the electrical contacts relative to the leading edge of the insulative material, thereby protecting the electrical contacts from electrostatic discharges. In alternate embodiments of the invention, the electrical connector may be a plug type electrical connector with the electrical conductor mounted on the leading edge of the projecting blades or may be a receptacle type electrical connector with the electrical conductor mounted to the leading edge of the insulative insert.

16 Claims, 2 Drawing Sheets

HIGH DENSITY ELECTRICAL CONNECTOR WITH ELECTROSTATIC DISCHARGE PROTECTION

BACKGROUND OF THE INVENTION

1. Field of the Invention

The invention relates to a connector for electrical equipment and, more particularly, to a high density electrical connector provided with protection from electrostatic discharge events.

2. Description of Related Art

It is well known that electrical devices are typically provided with at least one interface for electrical connection with other electrical devices. Generally, such interfaces are either a plug type connector, which is typically inserted into a similarly configured second connector to complete an electrical connection between the electrical contacts of the two, or a receptacle type connector, which typically receives a plug type connector to complete the electrical connection between the contacts. Recently, high density electrical connectors, both plug and receptacle type, which provide multiple low voltage electrical connections in a relatively small area, have become common, particularly in computer systems where large numbers of low voltage electrical connections are required. Each individual electrical connector included as part of a high density electrical connector typically includes an electrical contact providing an electrical connection with an electrical contact of a second connector and a signal pin which is used to connect the contact with an associated electrical device.

When connecting or disconnecting a first electrical device, for example a computer, to or from a second electrical device, for example a computer peripheral such as a printer, opposite charges on the two interfaces may result in an electrostatic discharge between the two. If the discharge propagates to a contact electrically associated with a semiconductor or other low power electrical device, the discharge could result in the destruction of the electrical device associated with the contact to which the discharge propagates. Furthermore, with the increased use of CMOS and other low power semiconductor components, the likelihood that electrostatic discharges will be destructive has increased. For example, expandable portable computers are typically provided with an external connector internally connected to the major electronic components of the portable computer, many of which are low power semiconductor components. Finally, any electrical equipment having an exposed connector risks destructive electrostatic discharges at any time.

In the past, the protection of electrical equipment from electrostatic discharges has been provided at the pin or component level. In such schemes, separate protection against electrostatic discharges would be provided for each component or pin deemed at risk. For example, a separate electronic voltage clamping device such as a metal oxide varistor (or "MOV"), a transient suppressor zener diode, an arc gap capacitor, a flash tube, a diode clamp circuit, or the like, would be installed, typically on the printed circuit board itself, to protect a low power component from voltage surges resulting from electrostatic discharges. While effective, protecting components from electrostatic discharge at the component level has become impractical to implement, particularly in multiple component circuits, due to cost and space constraints.

On the other hand, attempts to protect electrical equipment from electrostatic discharges at the connector level have been infrequent. One prior solution focussed on the insertion of extra metal blades which would project outwardly past the rows of contacts, typically mounted on shorter insulative blades, into a plug type connector. However, this prior solution added significantly to the cost of manufacturing a plug type connector. Furthermore, the proposed solution was not readily applicable to receptacle type electrical connectors and, as a result, electrostatic discharge protection has remained rare for receptacle type connectors. Finally, the use of additional blades merely for electrostatic discharge protection results is a highly inefficient use of connector space and is inconsistent with the modern trend toward increasingly higher density electrical connectors.

Outer shells constructed of a conductive material such as metal have also been used for providing electrostatic discharge protection for electrical connectors. However, an outer metal shell typically provides protection from electrostatic discharges only in the range of 8 to 20 Kv. In this relatively high voltage range, the length of the electrostatic discharge is sufficiently long such that the charge will jump to the object having the greatest charge potential, i.e., the outer metal shell. For electrostatic discharges at voltages below this range, however, the discharge length is considerably shortened. As a result, the discharge will often travel to the closest conductive object, typically a connector pin, rather than to the more distant but higher potential outer shell. Furthermore, the use of conductive outer shells for protection against electrostatic discharges, like the insertion of conductive blades, is inconsistent with the trend toward higher density electrical connectors. Increases in pin counts most often result in increasingly larger outer shells and, the larger the shell, the more likely that an electrostatic discharge will travel to an electrical contact, rather than to the outer shell.

SUMMARY OF THE INVENTION

In one embodiment, the present invention is of an electrical connector comprised of a block of insulative material having at least one electrical contact for providing electrical connections and an electrical conductor mounted thereto. The electrical conductor is positioned forward of the electrical contacts such that the electrostatic voltage potentials are discharged to the electrical conductor, thereby protecting the electrical contacts from electrostatic discharges. In one aspect of this embodiment, the block of insulative material includes a leading edge upon which the electrical conductor is mounted. In another aspect of this embodiment, the electrical connector further comprises a conductive outer shell attached to and surrounding the block of insulative material. The conductive outer shell is electrical connected with the electrical conductor such that the outer shell provides a path to ground for electrostatic discharges to the electrical conductor.

In another embodiment, the present invention is of a plug type multiple contact electrical connector which includes an insulative body portion having at least one outwardly projecting blade member. A plurality of electrical contacts are mounted to each of the projecting blade members. A piece of conductive material is mounted to the leading edge of at least one of the projecting blade members to provide electrostatic discharge protection means for the connector. In one aspect of this embodiment, the connector further includes a conductive outer housing at least partially surrounding the sidewalls of the outwardly projecting blade member or members. Preferably, the outer conductive housing should be in electrical connection with the conductive material. In another aspect of this embodiment, the leading edges of the outwardly projecting blades are grooved and the conductive material mounted in the grooves.

In yet another embodiment, the present invention is of a receptacle type multiple contact electrical connector which comprises a conductive outer shell and an insulative insert mounted along the interior sidewalls of the outer shell, thereby defining at least one blade receiving socket. A plurality of electrical contacts are mounted to the insulative insert and a conductive material is mounted to the leading edge of the insulative insert, thereby protecting the electrical contacts from electrostatic discharges. In one aspect of this embodiment, the insulative insert includes at least one horizontal extension having a leading edge and extending between the sidewalls of the conductive shell. In another aspect of this embodiment, the conductive material extends across the leading edge of the insulative insert socket and terminates in an electrical connection with the conductive housing.

In still yet another embodiment, the present invention is of an electrical connector which comprises a insulative base member having a pair of sidewalls and a front edge with a groove formed therein. At least one electrical contact is mounted to the sidewalls and an electrical conductor having a plurality of discrete discharge surfaces in insertably mounted within the groove such that the discrete discharge surfaces project beyond the front edge.

It is an object of this invention to provide a high density electrical connector having protection from electrostatic discharges.

It is another object of this invention to provide a high density electrical connector which provides protection from electrostatic discharges for electrical contacts of both plug type and receptacle type connectors without affecting the spacing of the electrical contacts.

It is yet another object of this invention to provide a high density electrical connector having a single electrostatic discharge protection means for multiple electrical contacts.

BRIEF DESCRIPTION OF THE DRAWINGS

The present invention may be better understood and its numerous objects, feature and advantages will become apparent to those skilled in the art by referencing the accompanying drawings in which.

DETAILED DESCRIPTION OF THE INVENTION

Figure 1:
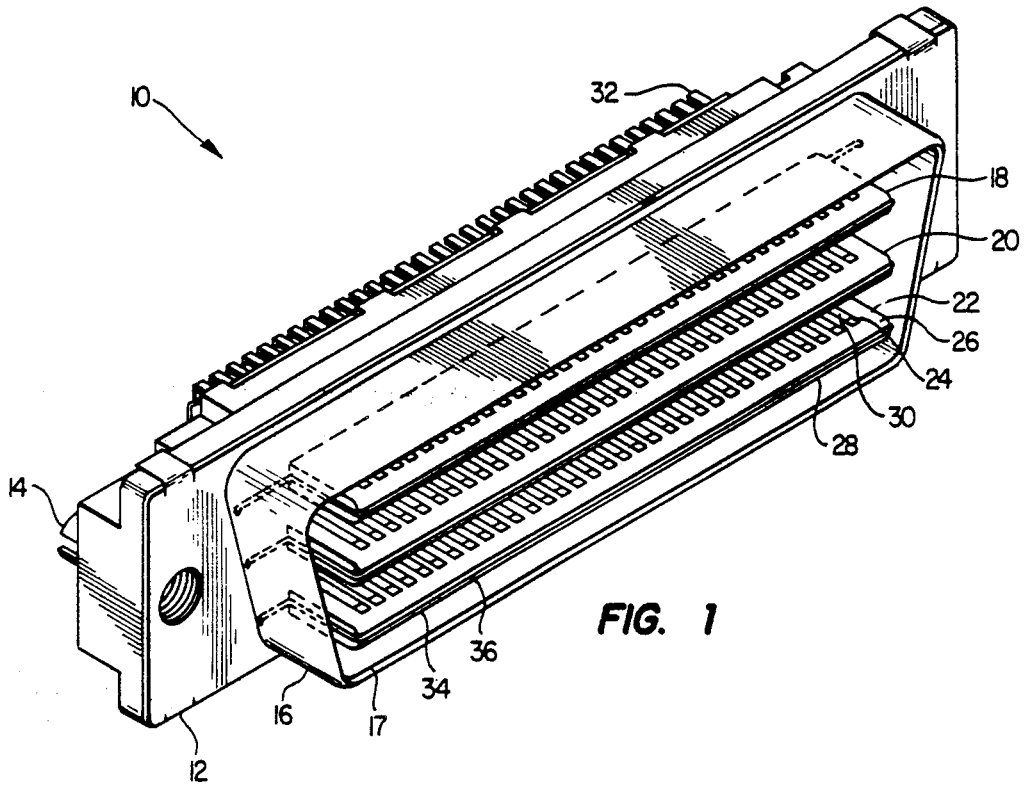
FIG. 1 is a perspective view of a high density plug type electrical connector provided with protection from electrostatic discharges and which is constructed in accordance with the teachings of/the present invention.

Referring first to FIG. 1, a plug type electrical connector 10 provided with protection from electrostatic discharges and constructed in accordance with the teachings of the present invention shall now be described in detail. The plug type electrical connector 10 includes a body portion 12 constructed of an insulative material such as plastic. The body portion 12 includes means for mounting the plug type connector 10 to an associated electrical component. For example, apertures 14 are provided for screw mounting the plug type connector 10 onto an electrical cable (not shown) such as that which would permit the interface of the plug type connector 10 with a printer or other electrical device (also not shown).

Mounted on the front surface of the body 12 is an open ended outer shell 16, preferably constructed of a conductive material such as metal, which defines an interior space 17. The outer shell 16 may be constructed in any desired shape consistent with the desired connector density although a generally rectangular or generally trapezoidal shape is particularly well suited for high density connector applications. Mounted within the interior space 17 defined by the outer shell 16 are a first connector blade 18, a second connector blade 20 and a third connector blade 22. Each connector blade 18, 20, 22 is constructed of an insulative material such as a plastic or other polymer and may either be mounted to or integrally formed with the body 12 of the plug type connector 10. Here, the plug type connector 10 may be provided with any number of connector blades consistent with the desired connector pin density and subject to the size constraints of the outer shell 16. Each connector blade 18, 20, 22 is provided with a series of slots 24 along both its top side 26 and its bottom side 28.

Insertably mounted in each slot 24 on the top side 26 and the bottom side 28 of the connector blades 18, 20, 22 is an electrical contact 30 constructed of a conductive material. Each electrical contact 30 corresponds to an individual electrical connection to be completed upon insertion of the plug type connector 10 into a receptacle type connector to be more fully described below. Each electrical contact 30 is electrically connected to a corresponding pin connector 32 which extends from the back side of the body 12. In turn, the pin connector 32 may be connected to an electronic component such as a semiconductor device mounted on a printed circuit board or an electrical cable, connector or other device. Depending on the particular electrical connection for which the pin connectors 32 are contemplated, the pin connectors 32 may be bent at a 90 degree angle as illustrated in FIG. 1 or may extend straight out from the back side of the body 12. The particular number of connector blades and the particular number of electrical contacts provided per connector blade may be varied depending on the desired connector density desired, although in the embodiment disclosed herein, a 3 connector blade, 198 pin plug type connector where each electrical contact 30 is separated by 0.5 millimeter from adjacent electrical contacts is specifically contemplated.

Each blade 18, 20, 22 upon which a plurality of electrical contacts 30 are insertably mounted thereon includes a leading edge 34 upon which a piece of conductive material has been mounted thereon. In the embodiment of the invention illustrated in FIG. 1, the piece of conductive material is disclosed in the form of a strip 36. It is fully contemplated, however, that, in alternate embodiments of the invention, the piece of conductive material may be provided in numerous configurations, including, but not limited to a wire, plate, or bar of conductive material. It is further contemplated that, in still yet other alternate embodiments of the invention, the piece of conductive material may be provided either on the surface of the blade 22, either by direct mounting or by a deposition process, or inserted into a groove or other indentation provided along the leading edges 34 of the connector blades 18, 20, 22.

Each strip 36 of conductive material extends along the entire length of the leading edge 34 of each connector blade 18, 20, 22, bends a first time so that the strip 36 can extend along the surface of the sidewalls of the connector blades 18, 20, 22 and bends a second time so that the strip 36 can extend along the body 12 where the strip 36 terminates in an electrical connection with the conductive outer shell 16. As each strip 36 of conductive material is electrically connected to the outer shell 16, a conductive path is provided from the leading edge 34 of each connector blade, 18, 20, 22 to the conductive outer shell 16 of the plug type connector 10.

Figure 2:
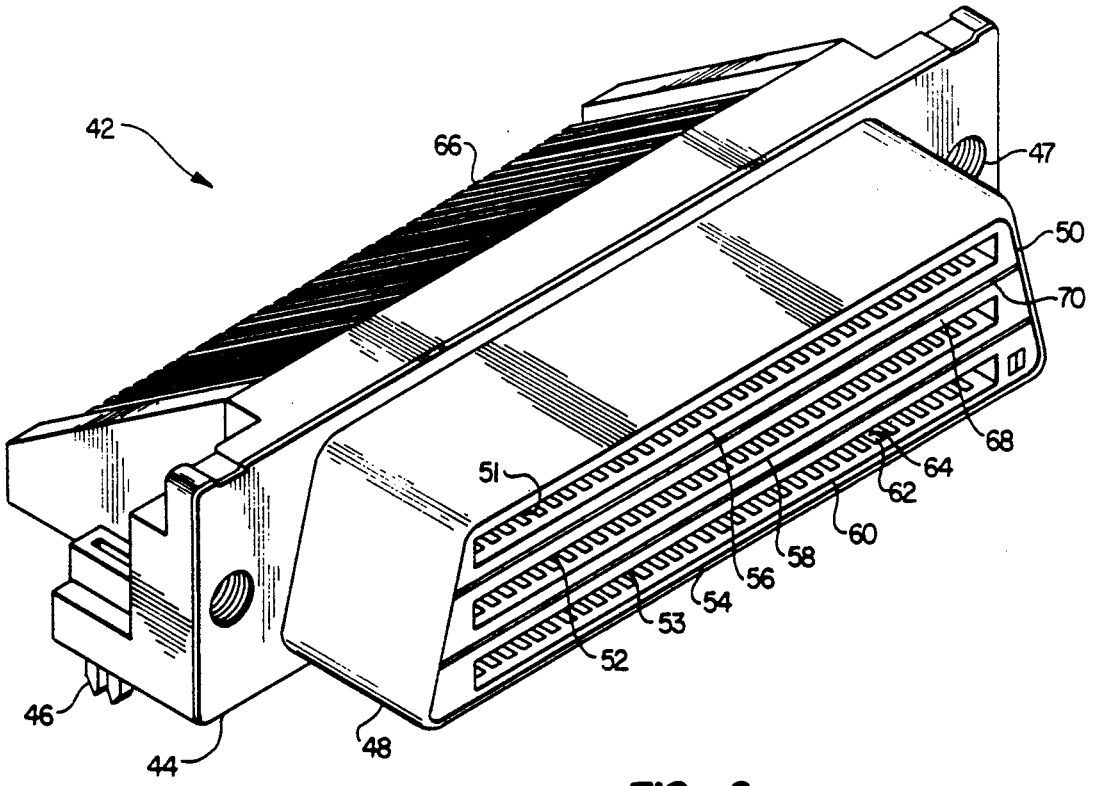
FIG. 2 is a perspective view of a high density receptacle type electrical connector provided with protection from electrostatic discharges and which is also constructed in accordance with the teachings of the present invention.

Referring next to FIG. 2, a receptacle type electrical connector 42 provided with protection from electrostatic discharges and also constructed in accordance with the teachings of the present invention shall now be described in detail. The receptacle type electrical connector 42 includes a body 44 constructed of an insulative material. Extending downwardly from the body 44 of the receptacle type connector 42 are mounting prongs 46. Mounting prongs 46 may be inserted in corresponding openings in a printed circuit board (not shown) or other device having electronic components to vertically mount the receptable type connector 42 on the aforementioned printed circuit board or other device. Alternately, apertures 47 may be utilized to horizontally screw mount the receptacle type connector 42 onto an electrical cable (not shown).

Mounted on the front side of the body 44 of the receptacle type connector 42 is an open ended outer shell 48, preferably constructed in a generally rectangular or trapezoidal shape consistent with the demands of a high density connector configuration. The outer shell 48 should be constructed of a conductive material such as metal and be sized and shaped for easy mating with a corresponding plug type connector 10. Insertably mounted within the interior of the outer shell 48 is an insert 50 constructed of an insulative material 50. The insert 50, which, as to be more fully described below, is used to provide surfaces for mounting electrical contacts thereon, completely surrounds the sidewalls of the conductive outer shell 48 and may include first, second, third and forth horizontal extensions 51, 52, 53, 54 extending laterally across the interior of the conductive shell 48, thereby defining first, second and third connector sockets 56, 58, 60 for receiving a corresponding one of the connector blades 18, 20, 22 of the plug type connector 10. In the specific embodiment of the invention described herein, the horizontal extensions 51 and 52 define the socket 56 for receipt of the connector blade 18, the horizontal extensions 52 and 53 define the socket 58 for receipt of the connector blade 20 and the horizontal extensions 53 and 54 define the socket 60 for receiving the connector blade 22.

Each horizontal extension 51, 52, 53, 54 is provided with a series of slots 62 formed therein. Insertably mounted in each slot 62 is an electrical contact 64 constructed of a conductive material. Each electrical contact 64 corresponds to an individual electrical connection to be completed upon insertion of the receptacle type connector 42 into a plug type connector 10 such as that illustrated in FIG. 1. Each electrical contact 64 is electrically connected to a corresponding pin connector 66 which extends from the back side of the body 44. In turn, the pin connector 66 may be connected to an electronic component such as a semiconductor device mounted on a printed circuit board or an electrical cable, connector or other device. Depending on the particular electrical connection for which the pin connectors 66 are contemplated, the pin connectors 66 may be bent at a 90 degree angle as illustrated in FIG. 2 or may extend straight out from the back side of the body 44. The particular number of sockets and electrical contacts provided per socket may be varied depending on the desired connector density desired, although in the embodiment disclosed herein, a 3 socket, 198 pin receptacle type connector where each electrical contact 64 is separated by 0.5 millimeter from adjacent electrical contacts is specifically contemplated.

Mounted along a front edge 68 of both second and third horizontal extensions 52, 53 of insulative insert 50 is a piece of conductive material such as metal. As before, while the particular embodiment of the invention described herein contemplates the piece of conductive material being configured in the form of a strip 70, it is fully contemplated that the piece of conductive material may be provided in numerous other configurations such as in the form of a wire, plate or bar. Preferably, each strip 70 of conductive material should be insertably mounted in a groove 72 in the horizontal extensions 52, 53 of insulative insert 50. It is equally acceptable to surface mount the strip 70. Each strip of conductive material 70 extends along the entire length of the horizontal extensions 52, 53 and terminates in an electrical connection with the conductive outer shell 48. As each strip 70 of conductive material is electrically connected to the outer shell 48, a conductive path is provided from the horizontal extensions 52, 53 which separate sockets 56 and 58 and sockets 58 and 60, respectively, to the outer shell 48.

Figure 3:
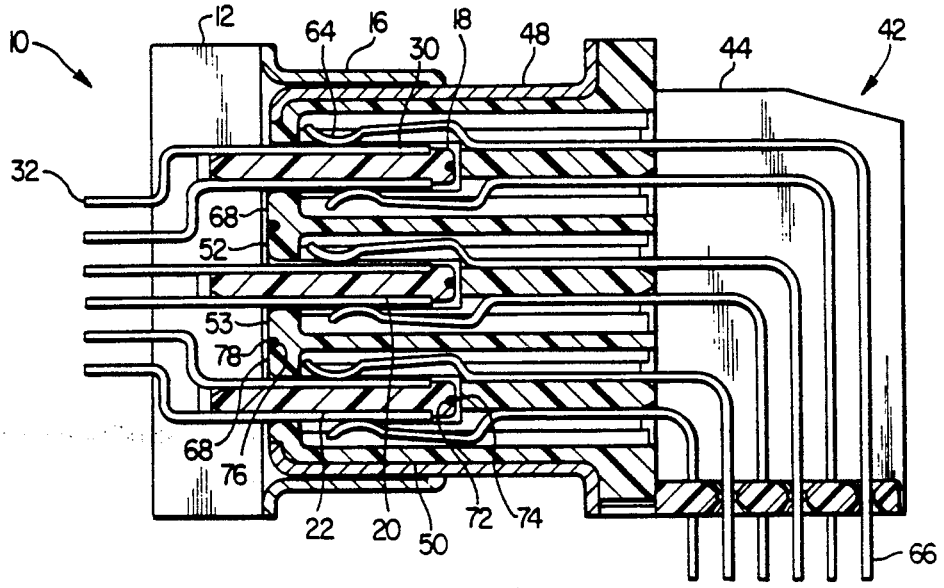
FIG. 3 is a cross-sectional view of the plug type connector of FIG. 1 mated with the receptacle type connector of FIG. 2.

Referring next to FIG. 3, a cross-sectional view of the plug type connector 10 of FIG. 1 mated with the receptacle type connector 42 of FIG. 2 may now be seen. As previously described, the plug type connector 10 includes the insulative base 12, the conductive outer shell 16 extending outwardly from the base 12 and first, second and third insulative connector blades 18, 20, 22 which extend outwardly from the base 12 a distance slightly greater than the outward extension of the conductive outer shell 16. A groove 72 is provided along the leading edge 34 of each connector blade 18, 20, 22 and a conductive wire 74 is insertably mounted, for example by snap mounting, therein to provide the previously described electrostatic discharge path for the plug type connector 10.

Also as previously described, the receptacle type connector 42 includes the insulative base 44, the conductive outer shell 48 and the insulative insert 50. The front edges 68 of the horizontal extensions 52, 53 are provided with a groove 76 and a conductive wire 78 is insertably mounted, for example by snap mounting, therein to provide the previously described electrostatic discharge path for the receptacle type connector 42. To electrically connect the electrical contacts 30 of plug type connector 10 and the electrical contacts 64 of receptacle type connector 42, the plug 10 and the receptacle 42 are mated together, thereby inserting connector blades 18, 20 and 22 into sockets 56, 58, 60 until connector blades 18, 20 and 22 contact the insulative body 44 of receptacle type connector 42 and horizontal extensions 51, 52, 53, 54 contact the insulative body 12 of the plug type connector 10. Once mated, the plug contacts 30 would be in electrical connection with the receptacle contacts 64, thereby completing the desired electrical connection between the plug connector pins 32 and the receptacle connector pins 66.

By applying a conductive material on the leading edge 34 of each connector blade 18, 20, 22, the leading edge 34 of each connector blade 18, 20, 22 is provided with a conductive path to ground. In the absence of the aforementioned conductive paths to ground, the path for a low voltage electrostatic discharge originating from a point near the connector blades 18, 20, 22, for example, from a point immediately in front of the plug type connector 10, would travel to the nearest electrical contact 30, thereby producing a voltage surge that could destroy a low power semiconductor device connected to the electrical contact 30 receiving the electrostatic discharge. By providing a conductive path to ground which would be in closer proximity to the origination point for the electrostatic discharge than the electrical contacts 30, the electrostatic discharge would travel to one of the conductive wires 74, which, in turn, would provide a path to ground, i.e. the conductive outer shell 16, without damage to electrical components.

Figure 4:
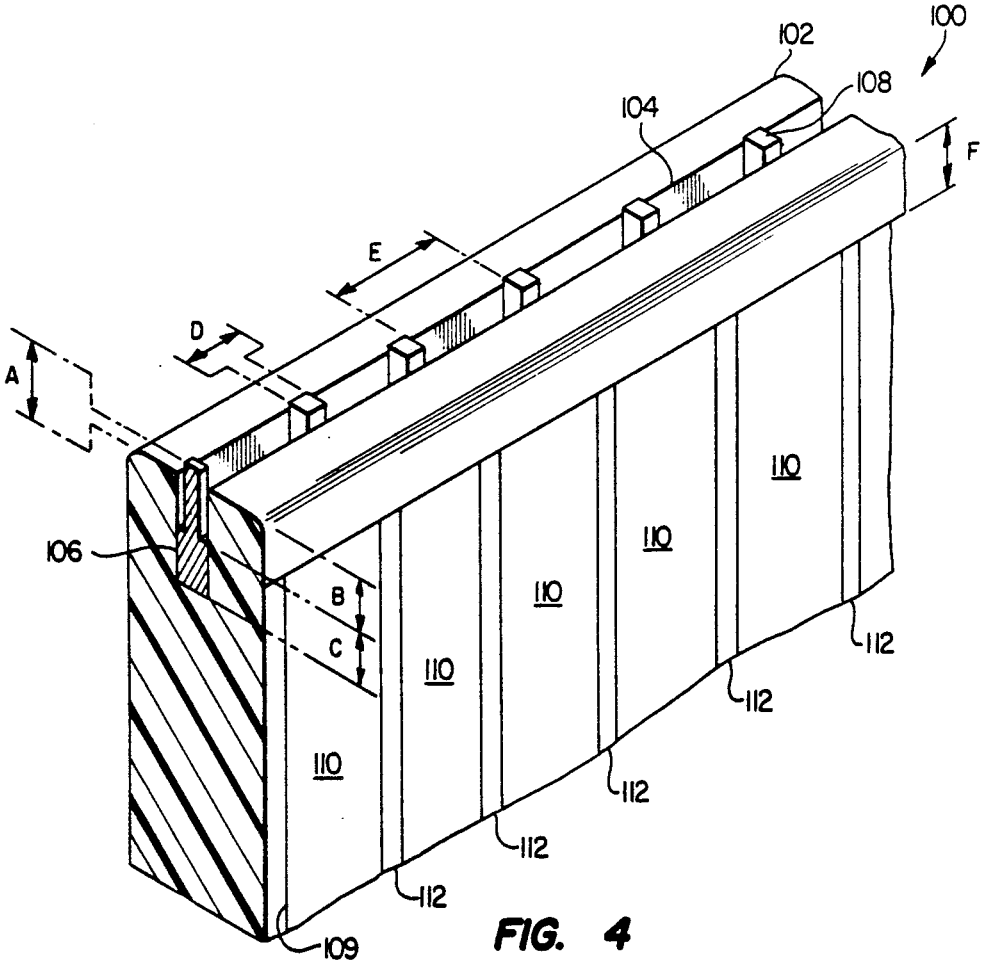
FIG. 4 is a partial cross-sectional view of another electrical connector provided with protection from electrostatic discharges and also constructed in accordance with the teachings of the present invention.

Referring next to FIG. 4, a second embodiment of an electrical connector provided with protection from electrostatic discharges and also constructed in accordance with the teachings of the present invention shall now be described in detail. In FIG. 4, a section of insulative material 100 is illustrated. It is contemplated that section 100 may be configured as part of a plug type connector 10 or a receptacle type connector 42. More specifically, the section 100 illustrated in FIG. 4 may be part of a connector blade such as connector blades 18, 20, 22 or may be configured as part of a horizontal extension such as horizontal extensions 51, 52, 53, 54 which define sockets 56, 58, 60. Similar to the embodiments of the invention already described, the section 100 includes a projecting front wall 102 having a notch 104 for receiving a piece of conductive material to be insertably mounted therein. Preferably, the conductive material should includes a base portion 106 fully inserted into the notch 104 and a plurality of projecting discharge points 108 extending outwardly from the base portion 106 beyond the projecting front wall 102. The base portion 106 should preferably extend the entire length of the section 100 and a distance "C" along the depth of the notch, thereby providing a large charge reservoir for electrostatic discharges. The projecting discharge points 108 should extend outwardly such that the discharge points 108 extends at least a distance "B" (which is slightly less than distance "C") to ensure that the origination point of the electrostatic discharge views the conductive material as the desired conductive discharge points 108. In such a manner the voltage gradient between the origin of the electrostatic discharge and the target discharge point is maximized. Also, the discharge points 108 should extend at least a small distance "A" beyond the projecting front wall 102 of the section 100. Preferably, the height of the discharge points 108 (distance A+distance B) should be generally equal to the height of the base 106 (distance C). Furthermore, each discharge point 108 should be sized a length "D" and separated a length "E" from an adjacent discharge point 108. Preferably, adjacent discharge points 108 should be separated by a distance generally equal to five times the length of a single discharge point 108. By minimizing the length D of the discharge points 108, however, with respect to the height A+B+C of the conductive material, the voltage gradient at the discharge points 108 will tend to increase, thereby making discharge to the discharge points 108 more likely.

As before, the section of insulative material 100 is provided with a series of slots 109 along its sides for insertably mounting electrical contacts 110 therein. Separating adjacent electrical contacts 110 are unslotted sections 112 of the insulative material 100 which preferably lie flush with the electrical contacts 110. Distance "F" is the distance from the electrical contacts 110 to the front wall 102 and distance F+A is the distance from an electrical contact 110 to its corresponding discharge point 108. By increasing the distance F+A, the separation E between adjacent electrical contacts 110 may be increased.

Thus, there has been described and illustrated herein, complimentary high density plug type and receptacle type electrical connectors which are provided with means for protecting the electrical contacts from electrostatic discharges, thereby providing a considerable degree of protection for low power semiconductor devices electrically associated with the electrical contacts. The electrostatic discharge protection means is well suited for high density electrical connectors and is provided at the connector level, thereby providing discharge protection for numerous electronic devices at a minimal cost. However, those skilled in the art will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation on the scope of the invention.

What is claimed is:

1. A plug type electrical connector comprising:

a block of insulative material, said block of insulative material including a widened base section and a narrower section integrally formed with and extending from said widened base section, said narrower section of said block of insulative material having a top side, a bottom side and a leading edge;

at least one electrical contact mounted to each of said top and bottom sides of said narrower section of said block of insulative material;

a conductive outer shell attached to said widened base section of said block of insulative material, said conductive outer shell at least partially surrounding said narrower section of said block of insulative material; and an electrical conductor mounted to said narrower section of said block of insulative material, said electrical conductor positioned forward of said top and bottom side mounted electrical contacts relative to said leading edge such that electrostatic voltage potentials are discharged to said electrical conductor;

wherein said leading edge of said narrower section of said block of insulative material extends a slightly greater distance outwardly than a front edge of said conductive outer shell and wherein said narrower section of said block of insulative material further comprises sidewalls, said electrical conductor mounted on said leading edge of said insulative block extending along said sidewalls and the surface of said widened base section, said electrical conductor terminating at said conductive outer housing.

2. An electrical connector as set forth in claim 1 wherein said leading edge of block of insulative material is grooved and said electrical conductor is mounted in said groove.

3. A plug type multiple contact electrical connector comprising:

a body portion formed from an insulative material, said body portion having a base and at least one outwardly projecting blade member extending from said base and terminating in a leading edge;

a plurality of electrical contacts mounted to each of said at least one projecting blade members;

an outer housing formed from an electrically conductive material and attached to said insulative body portion, said conductive outer housing at least partially surrounding said at least one projecting blade member;

a conductive material mounted on the leading edge of at least one of said projecting blade members, said conductive material extending along the surface of said insulative body portion and terminating at an electrical connection with said conductive outer housing.

4. A plug type electrical connector as set forth in claim 3 wherein said leading edges of said projecting blade members extend a slightly greater distance outwardly than a front edge of said conductive outer housing, wherein each of said at least one projecting blade members further include sidewalls and wherein said conductive material mounted on the leading edges of each of said at least one projecting blade members extend along said sidewalls of said projecting blade member and the surface of said insulative body portion, said conductive material terminating at said conductive outer housing.

5. A plug type electrical connector as set forth in claim 4 wherein each of said electrical contacts further comprises an electrical contact for providing a first electrical connection and a pin connector for providing a second electrical connection.

6. A plug type electrical connector as set forth in claim 5 wherein said leading edge of each of said projecting blade members is grooved and wherein said conductive material further comprises a conductive wire insertably mounted into each of said grooves.

7. A plug type electrical connector as set forth in claim 6 wherein said at least one projecting blade member further comprises first, second and third projecting blades.

8. A plug type electrical connector as set forth in claim 7 wherein said projecting blades further include top and bottom sides and wherein electrical contacts are mounted on both said top and bottom sides of each of said projecting blades.

9. A plug type electrical connector as set forth in claim 8 wherein said top and bottom sides of each of said projecting blades are slotted and wherein said electrical contacts are insertably mounted in said slots.

10. An electrical connector comprising:

a base member formed from an insulative material, said base member having a pair of sidewalls and a front edge with a groove formed therein;

at least one electrical contact mounted to said sidewalls; and means for protecting said electrical contacts from electrostatic discharges;

wherein said electrostatic discharge protection means comprises an electrical conductor insertably mounted within said groove, said electrical conductor having a plurality of discrete electrostatic discharge surfaces projecting beyond said front edge.

11. An electrical connector as set forth in claim 10 wherein said electrical conductor further comprises a base section insertably mounted in said groove and a plurality of projections integrally formed with and extending from said base section, wherein each of said projections extends beyond said front edge of said base member, thereby providing discharge points which protect said electrical connector from electrostatic discharges to said electrical contacts.

12. An electrical connector as set forth in claim 11 wherein each of said plurality of projections are narrower than said base section.

13. An electrical connector as set forth in claim 11 wherein said base section extends along the entire length of said groove, thereby providing a large charge reservoir for point discharges of electrostatic energy.

14. An electrical connector as set forth in claim 11 wherein the height of the portion of said projections within said groove is slightly less than the height of said base section.

15. An electrical connector as set forth in claim 11 wherein the height of said projections is approximately equal to the height of said base section.

16. An electrical connector as set forth in claim 11 wherein adjacent projections should be separated by a distance approximately equal to five times the height of a single projection.

* * * * *